US009943125B2

(12) United States Patent
LeMarbe

(10) Patent No.: US 9,943,125 B2
(45) Date of Patent: Apr. 17, 2018

(54) QUICK RELEASE TUCK STRAP

(71) Applicant: Point Blank Enterprises, Inc., Pompano Beach, FL (US)

(72) Inventor: Randall Jered LeMarbe, Coral Springs, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 672 days.

(21) Appl. No.: 14/506,227

(22) Filed: Oct. 3, 2014

(65) Prior Publication Data

US 2015/0096111 A1 Apr. 9, 2015

Related U.S. Application Data

(60) Provisional application No. 61/887,118, filed on Oct. 4, 2013.

(51) Int. Cl.

| | |
|---|---|
| ***A44B 11/18*** | (2006.01) |
| ***A41F 1/00*** | (2006.01) |
| ***A41D 1/04*** | (2006.01) |
| ***A44B 18/00*** | (2006.01) |
| ***F41H 1/02*** | (2006.01) |
| *A41D 13/05* | (2006.01) |

(52) U.S. Cl.

CPC ..... *A41F 1/00* (2013.01); *F41H 1/02* (2013.01); *A41D 13/0518* (2013.01); *A41D 2300/32* (2013.01); *A41D 2300/33* (2013.01); *A41D 2400/44* (2013.01); *Y10T 24/1397* (2015.01); *Y10T 24/2708* (2015.01); *Y10T 24/3991* (2015.01)

(58) Field of Classification Search

CPC ..... A41D 13/0518; A41D 2300/32; A41D 2300/33; A41D 2400/44; A41F 1/00; F41H 1/02; Y10T 24/1397; Y10T 24/2708; Y10T 24/3991

See application file for complete search history.

(56) References Cited

U.S. PATENT DOCUMENTS 4,094,021 A * 6/1978 Rapp ..... E04H 4/10 24/306
5,259,093 A * 11/1993 D'Annunzio ..... A41D 13/0002 224/148.4
5,511,756 A * 4/1996 Spradling ..... A63B 71/0045 24/306

(Continued)

*Primary Examiner* — Robert Sandy
*Assistant Examiner* — David M Upchurch
(74) *Attorney, Agent, or Firm* — Honigman Miller Schwartz and Cohn LLP

(57) ABSTRACT

A releasable fastener system includes a first base material and a second base material being fastened together when the fastener system is in a fastened state and released from one another when the fastener system is in a released state. The fastener system further includes a stiffening member fastened to the second base material. A bottom loop is spaced from the first base material such that at least a portion of the stiffening member resides between the bottom loop and the first base material when the fastener system is in the fastened state. A top loop being spaced from the bottom loop such that a portion of the second base material resides between the top and bottom loops when the system is in the fastened state, wherein at least one of the top and bottom loops is fastened to the first base material.

23 Claims, 12 Drawing Sheets

(56) References Cited

U.S. PATENT DOCUMENTS

| | | | | |
|---|---|---|---|---|
| 6,279,804 | B1 * | 8/2001 | Gregg | A45F 5/02 2/255 |
| 6,553,579 | B1 * | 4/2003 | Gillen | A41D 13/0153 2/268 |
| 7,931,521 | B1 * | 4/2011 | Griffin | A41C 3/0028 2/336 |
| 7,963,427 | B2 * | 6/2011 | Calkin | A41D 13/0012 224/675 |
| 8,453,899 | B1 * | 6/2013 | Calkin | A45F 5/02 224/675 |
| 9,144,294 | B2 * | 9/2015 | Gregory | A41D 13/0012 |
| 2002/0092138 | A1 * | 7/2002 | Spiller | A01K 27/001 24/306 |
| 2005/0005343 | A1 * | 1/2005 | Johnson | F41H 1/02 2/102 |
| 2006/0220435 | A1 * | 10/2006 | Carter | A47C 1/124 297/440.14 |
| 2007/0212975 | A1 * | 9/2007 | Ausman | A41F 1/006 450/58 |
| 2009/0282595 | A1 * | 11/2009 | Branson | F41H 1/02 2/2.5 |
| 2010/0205708 | A1 * | 8/2010 | Storms, Jr. | A41D 13/05 2/2.5 |
| 2010/0287681 | A1 * | 11/2010 | Storms, Jr. | A41D 1/04 2/102 |
| 2011/0023207 | A1 * | 2/2011 | Storms, Jr. | A41D 1/04 2/102 |
| 2015/0153140 | A1 * | 6/2015 | Crye | F41H 1/02 2/102 |

* cited by examiner

FIG. 3A
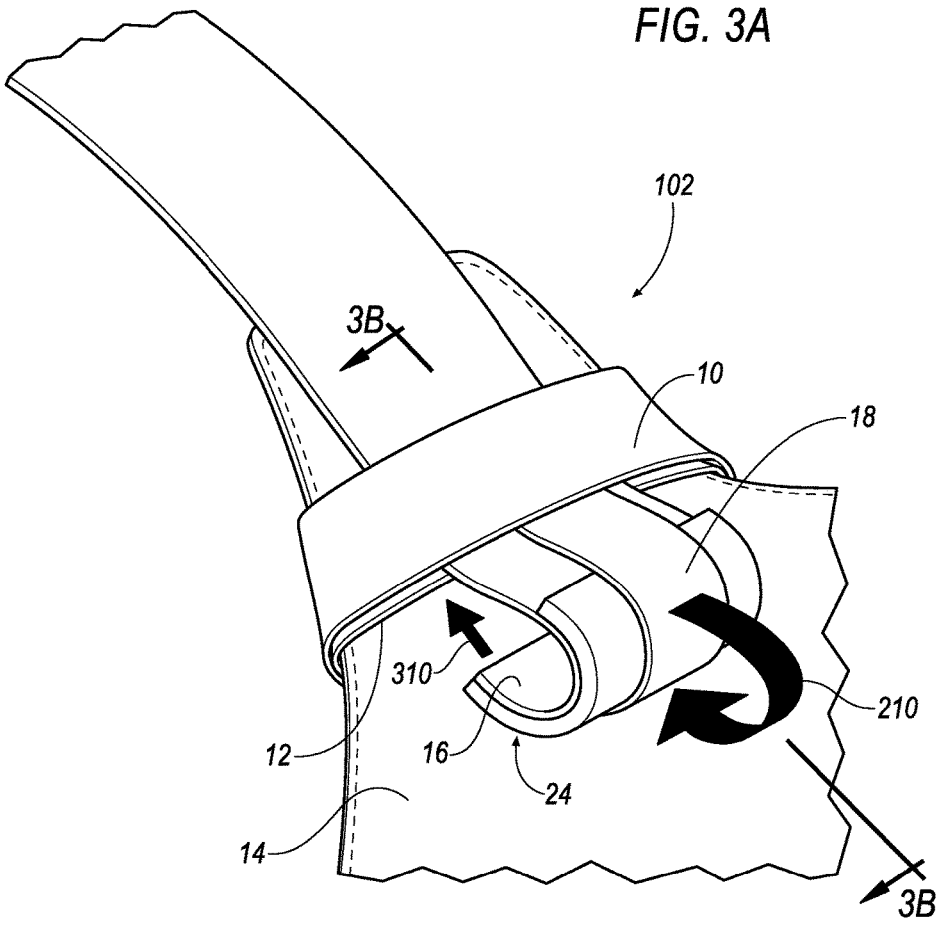
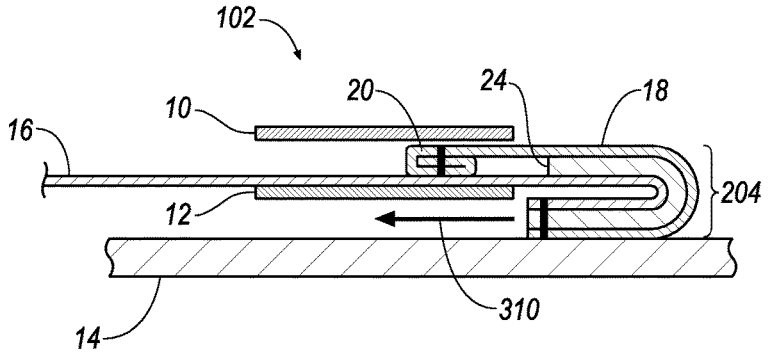
FIG. 3B

FIG. 4A
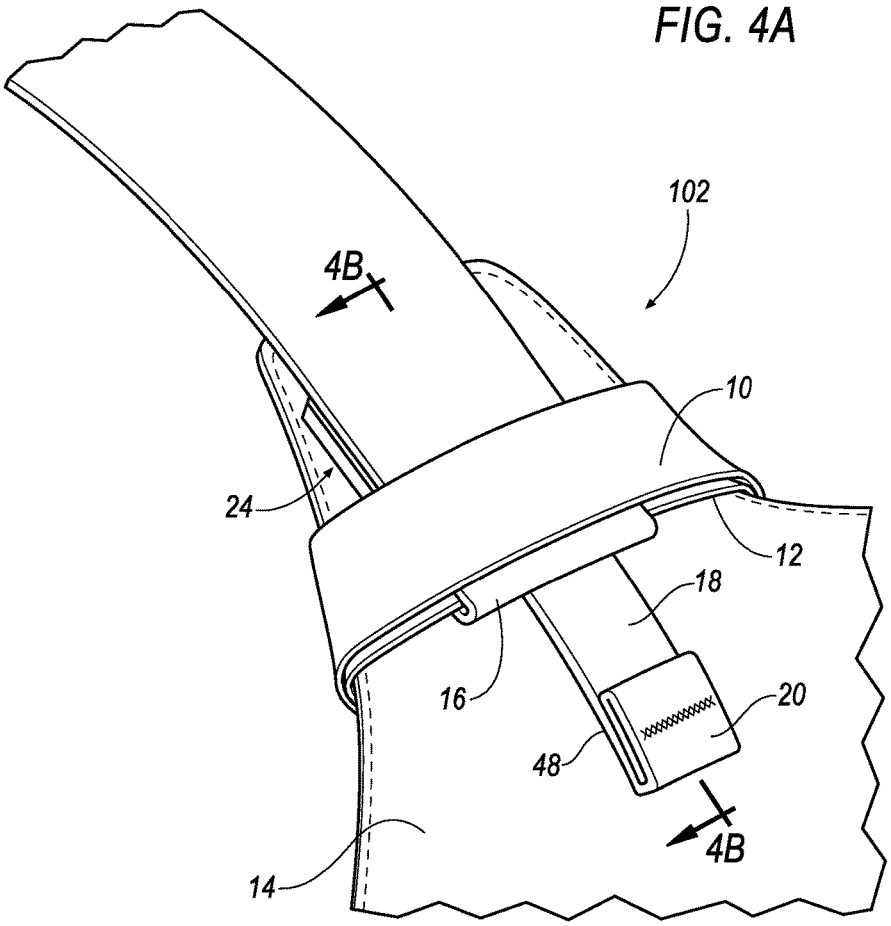
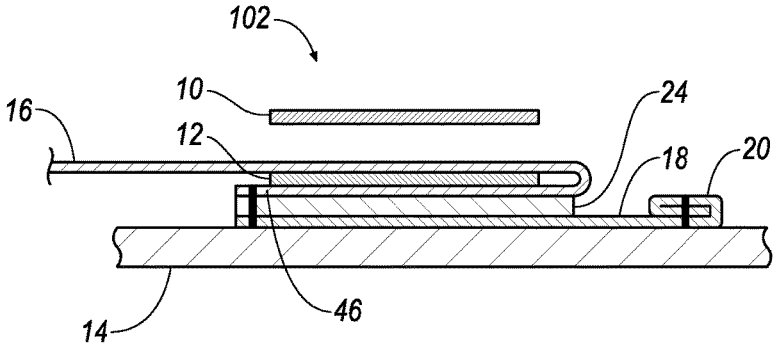
FIG. 4B

FIG. 5A
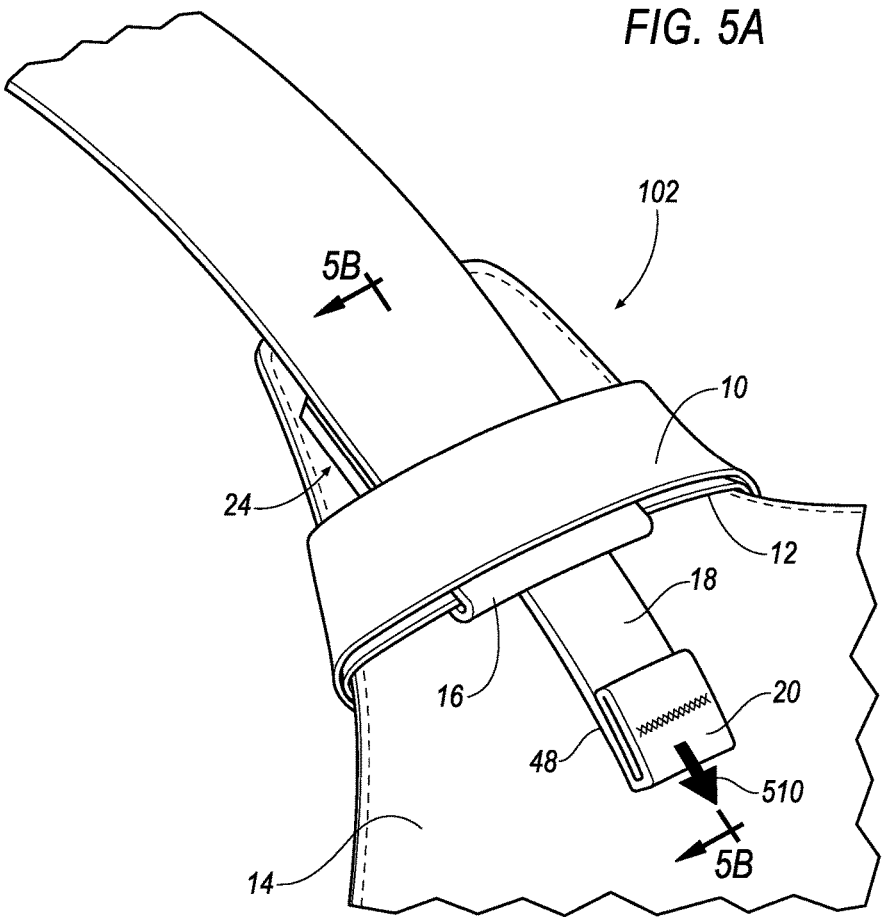
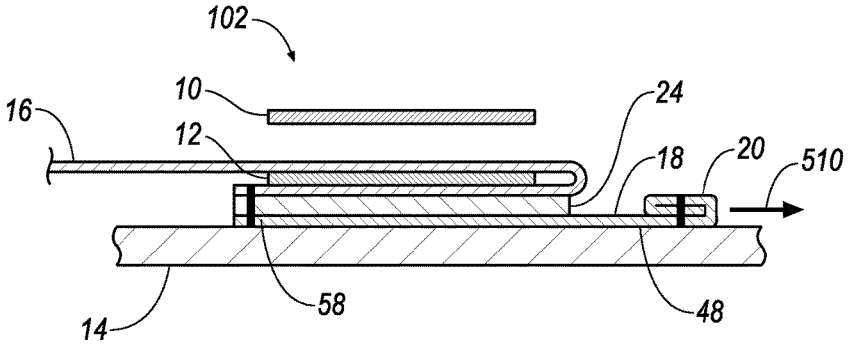
FIG. 5B

QUICK RELEASE TUCK STRAP

CROSS REFERENCE TO RELATED APPLICATIONS

This U.S. patent application claims priority under 35 U.S.C. § 119(e) to U.S. Provisional Application 61/887,118, filed on Oct. 4, 2013, which is entirely incorporated herein by reference.

TECHNICAL FIELD

This disclosure relates to releasable fastener systems. More specifically, this disclosure relates to a protective vest that uses a releasable fastener system.

BACKGROUND

A protective, or ballistic, vest is typically formed with a front ballistic panel portion and a rear ballistic back portion, which are secured to one another by detachable straps that pass under the arms of the user along the rib cage, and by a pair of shoulder straps that connect upper portions of the front and back portions and pass over the shoulders of the user. Protective vests are conventionally concealed beneath the user's uniform or worn over top of the user's uniform, but present a separate article of clothing from the user's uniform.

In the field, fast removal of the protective vest from the user is a priority for personal attending or treating the user if he or she becomes injured. Removal of the vest, however, requires multiple steps to unsecure the detachable straps that pass under the arms of the user and the shoulder straps passing over the shoulders of the user. For instance, multiple buckles may need to be located and properly disengaged under high pressure situations. Thus, undertaking multiple steps to remove the vest from the user is not desirable when time is of the essence to attend to an injured user and/or remove the user from a potentially dangerous situation.

SUMMARY

One aspect of the disclosure provides a releasable fastener system including a first base material and a second base material being fastened together when the fastener system is in a fastened state and released from one another when the fastener system is in a released state. The fastener system further includes a stiffening member fastened to the second base material. A bottom loop is spaced from the first base material such that at least a portion of the stiffening member resides between the bottom loop and the first base material when the fastener system is in the fastened state. A top loop being spaced from the bottom loop such that a portion of the second base material resides between the top and bottom loops when the system is in the fastened state, wherein at least one of the top and bottom loops is fastened to the first base material.

Implementations of the disclosure may include one or more of the following optional features. In some implementations, the releasable fastener system further includes a pull having a first end region and a second end region, the first end region may be one of integral or fastened to the stiffening member such that the stiffening member resides between the first end region of the pull tab and the second base material. In some examples, the pull releases the fastener system from the fastened state when the second end region of the pull is pulled to release the stiffening member from residing between the bottom loop and the first material. Optionally, the second end region of the pull terminates into a beaded end region formed by folding the second end portion upon itself to enable a grip for a user.

In some implementations, the residing of the stiffening member between the bottom loop and the first base material creates a leverage type attachment to fasten the second base material and the first base material together. Optionally, the stiffening member fastens to the second base material using hook and loop fasteners. In some examples, one of the top and bottom loops is fastened to the first base material, while in other examples, both of the top and bottom loops are fastened to the first base material. Optionally, the first and second base materials are fastened to a vest. Optionally, at least one of the first or second base materials is at least indirectly fastened to at least one of a back-pack, a carrying pouch, or a belt.

Another aspect of the disclosure provides a releasable fastener system for a protective vest. The releasable fastener system includes a first strap portion and a second strap portion forming a shoulder strap when the second strap portion fastens to the first strap portion, and top and bottom loops wherein at least one of the top or bottom loops is fastened to the first strap portion, the bottom loop residing between the top loop and the first strap portion. The releasable fastener system further includes a pull having a first end region fastened to the second strap portion. The top loop and the bottom loop being spaced such that a portion of the second strap portion resides between the top and bottom loops when the second strap portion fastens to the first strap portion. The bottom loop and the first strap portion being spaced such that the second strap portion resides between the bottom loop and the first strap portion to provide a leverage type attachment for fastening the second strap portion to the first strap portion This aspect may include one or more of the following optional features. In some implementations, the releasable fastener system further includes a stiffening member residing between the first end region of the pull and a terminal portion of the second strap portion. In some examples, the stiffening member attaches to the terminal portion of the second strap portion using at least one of hook and loop fasteners, sewing, rivets, or adhesives. Optionally, the stiffening member attaches to the first end region of the pull using at least one of sewing, rivets, or adhesives. Optionally, the stiffening member is fabricated from at least one of a rigid or semi-rigid material.

In some implementations, the pull having the first end region fastened to the second strap portion includes the first end region of the pull attaching to a terminal portion of the second strap portion using at least one of sewing, rivets, or adhesives to fasten the pull to the second end portion. Optionally, the pull is fabricated from at least one of a polyethylene or acetyl. Optionally, the pull is encased in at least one of nylon, Cordura, or polyester.

Another aspect of the disclosure provides a method for fastening first and second base materials. The method includes feeding a leading edge of the second base material, a stiffening member, and a pull through a first spacing between a top loop and a bottom loop associated with the first base material. The stiffening member and a first end region of the pull are fastened to the second base material. The leading edge of the second base material, the stiffening member, and the first end region of the pull tuck under the bottom loop upon exiting the first spacing. A second spacing between the bottom loop and the first base material receives the leading edge of the second base material, the stiffening member, and the first end region of the pull to provide a leverage type attachment between the first and second base materials for fastening the first and second base materials.

This aspect may include one or more of the following optional features. In some implementations, pulling a second region of the pull to release the leverage type attachment between the first and second base materials. In some examples, upon releasing the leverage type attachment, pulling the second base material through the first spacing between the top and bottom associated with the first base material releases the second base material from the first base material.

The details of one or more implementations of the disclosure are set forth in the accompanying drawings and the description below. Other aspects, features, and advantages will be apparent from the description and drawings, and from the claims.

DESCRIPTION OF DRAWINGS

FIGS. 3A-3B are isometric (FIG. 3A) and side (FIG. 3B) views of the releasable fastener system of FIG. 1 during the fastening step.

FIGS. 4A-4B are isometric (FIG. 4A) and side (FIG. 4B) views when the releasable fastener system of FIG. 1 is in a fastened state.

FIGS. 5A-5F are isometric (FIG. 5A) and side (FIGS. 5B-5F) views through a plurality of steps for releasing the releasable fastener system of FIG. 1 from the fastened state.

Like reference symbols in the various drawings indicate like elements.

DETAILED DESCRIPTION

Figure 1:
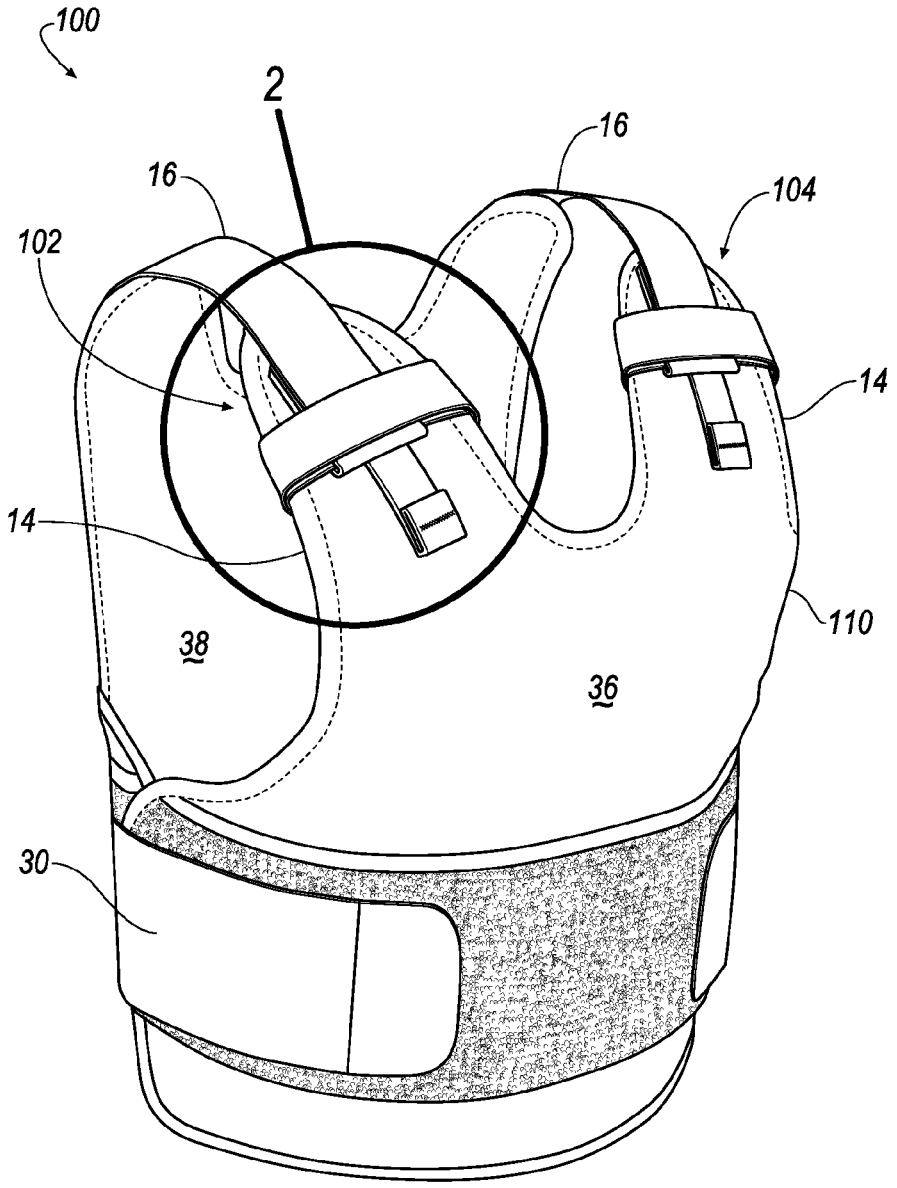
FIG. 1 is an isometric view of a vest including back and front portions fasted to a user by a releasable fastener system.

Referring to FIG. 1, an isometric view 100 of a vest 110 including a releasable fastener system 102 is illustrated. In the example shown, two releasable fastener systems 102 and 104 each associated with a corresponding shoulder strap of the vest 110 are utilized. The shoulder straps pass over the shoulders of a user wearing the vest 110. In other examples, however, one or more releasable fastener systems may be utilized for fastening and unfastening a belt, backpack, carrying pouch, or other applications where fastening and unfastening two base materials is desired. Area 2 encloses the releasable fastener system 102 corresponding to the right shoulder strap of the vest 110, as referenced by FIGS. 2-12.

The vest 110 is worn by a user, and in the example shown, the vest 110 is a protective vest. In some implementations, the protective vest 110 includes a soft body armor using one or more layers of protective fabric, such as Kevlar. In other implementations, the protective vest includes hard body armor wherein the vest may include slots for receiving a ceramic, metal or other rigid plates that resist penetration by projectiles. The present disclosure is not limited to the protective vest being indicative of either one of soft or hard body armor, and selection thereof, or combinations of both soft and hard materials, can be based upon the ballistics of the projectiles anticipated to be used in specific scenarios.

In some implementations, the shoulder straps include releasable first and second base materials 14 and 16, respectively. In the example shown, the first base material 14 corresponds to a first strap portion and the second base material 16 corresponds to a second strap portion. The terms "first base material" and "first strap portion" will be used interchangeably herein, and the terms "second base material" and "second strap portion" will also be used interchangeably herein. In some examples, the first strap portion 14 is associated with a front portion 36 (or front panel) of the vest 110 and the second strap portion 16 is associated with a back portion 38 (or rear panel) of the vest 110. For instance, the first strap portion 14 may be integral to the front portion 36 and the second strap portion 16 may be integral to the back portion 38. The length of the first and/or second strap portions 14, 16, respectively, may be adjustable to accommodate a size of the user wearing the vest 110. The first and second base materials may be fabricated from the same, or different, materials. In other examples, one or both of the strap portions 14 and 16 are fabricated/formed from fabric or other pliable materials. The strap portions 14 and 16 may include a width from about, and including, one (1) inch to about, and including, two (2) inches.

Figure 6:
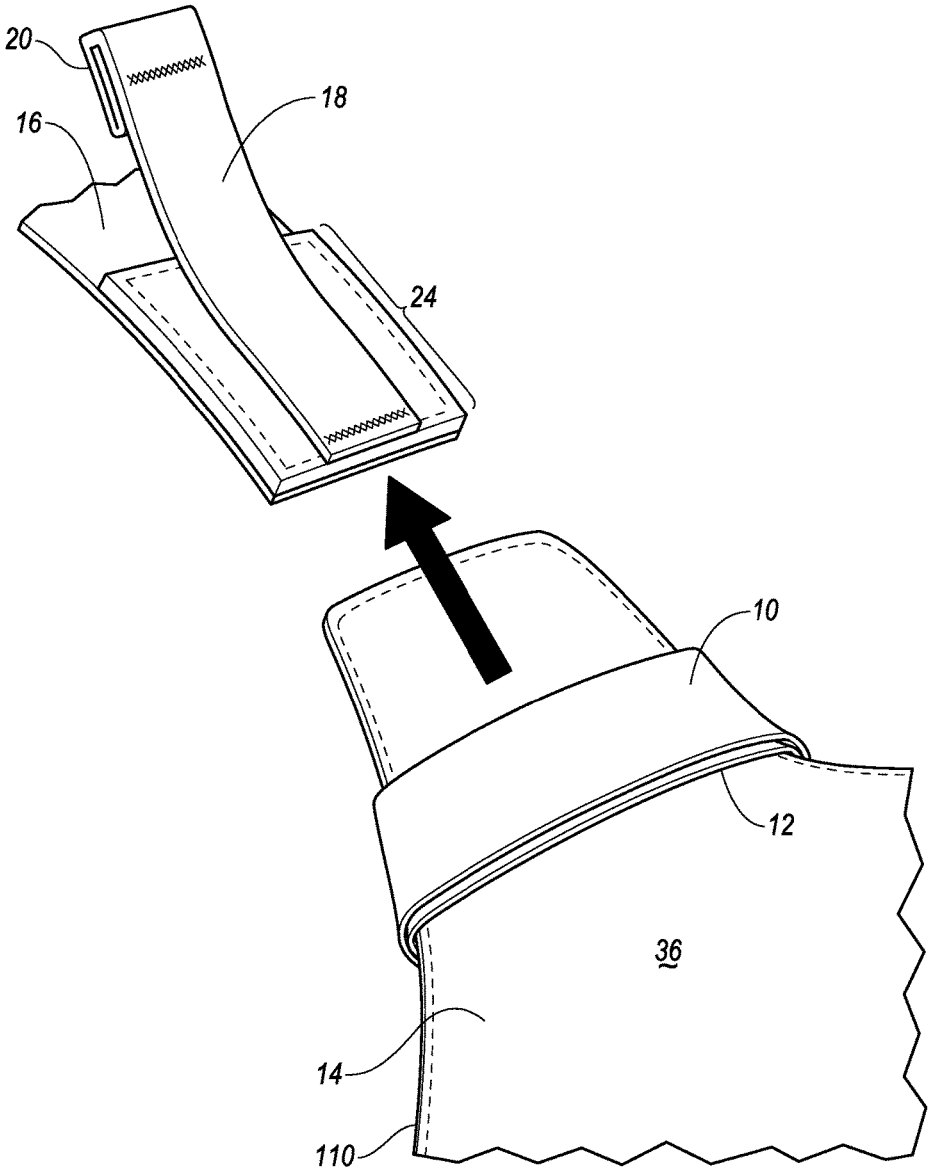
FIG. 6 is an isometric view of the releasable fastener system of FIG. 1 in the released state.

In the example shown, the releasable fastener system 102 is in a fastened state where each first strap portion 14 and each corresponding second strap portion 16 fasten together to form the shoulder straps that secure the front portion 36 to the back portion 38. Accordingly, the vest 110 may secure to the user by fastening together the first and second strap portions 14 and 16, respectively, of the releasable fastener system 102. In some examples, the vest 110 may be removed from the user when the releasable fastener system 102 is in a released state (FIG. 6). In the released state, the second strap portions 16 are released from the corresponding first strap portions 14. The vest 110 may further include cummerbund portions (e.g., first and second ends) 30 that may secure to, and release from, the front portion 36.

Figure 2A:
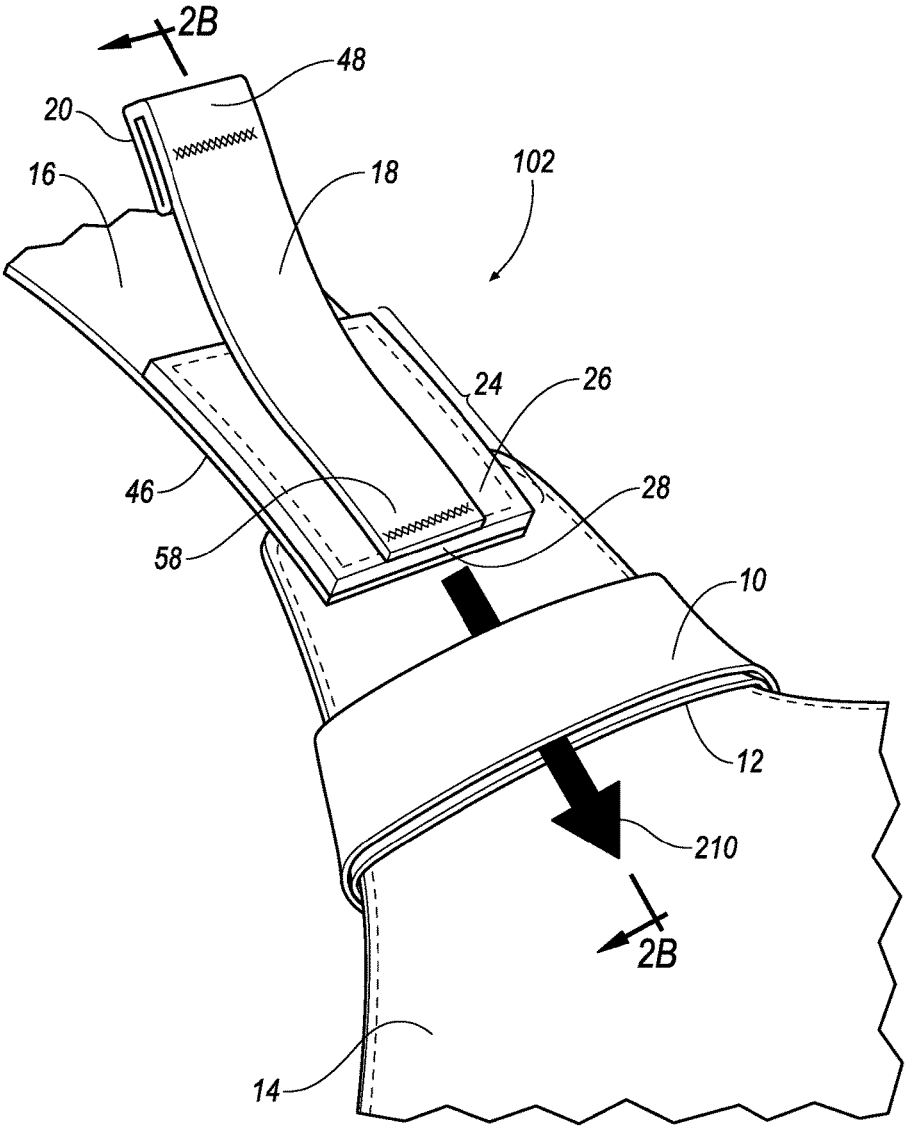
FIGS. 2A-2C are isometric (FIG. 2A) and side (FIGS. 2B-2C) views of the releasable fastener system of FIG. 1 when a fastening step initiates.
Figure 2B:
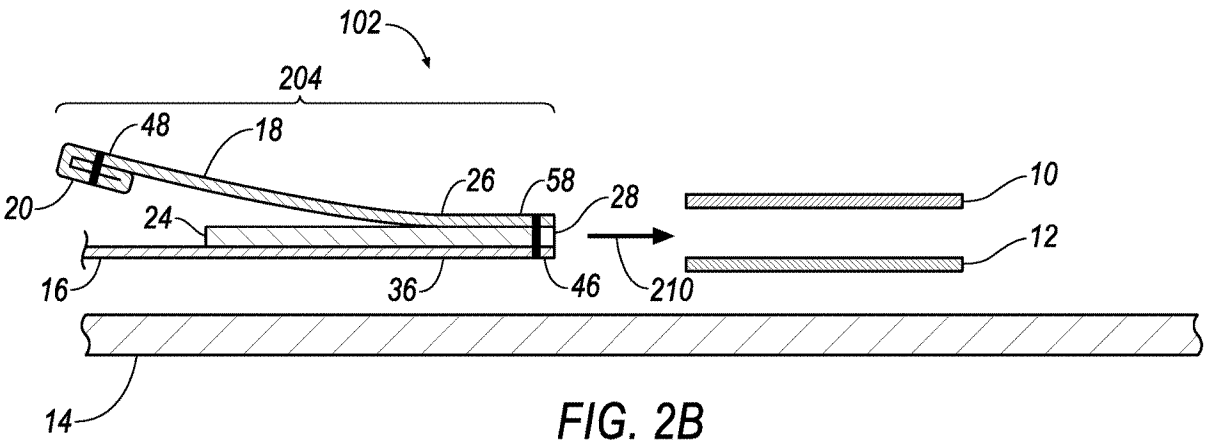
Figure 2C:
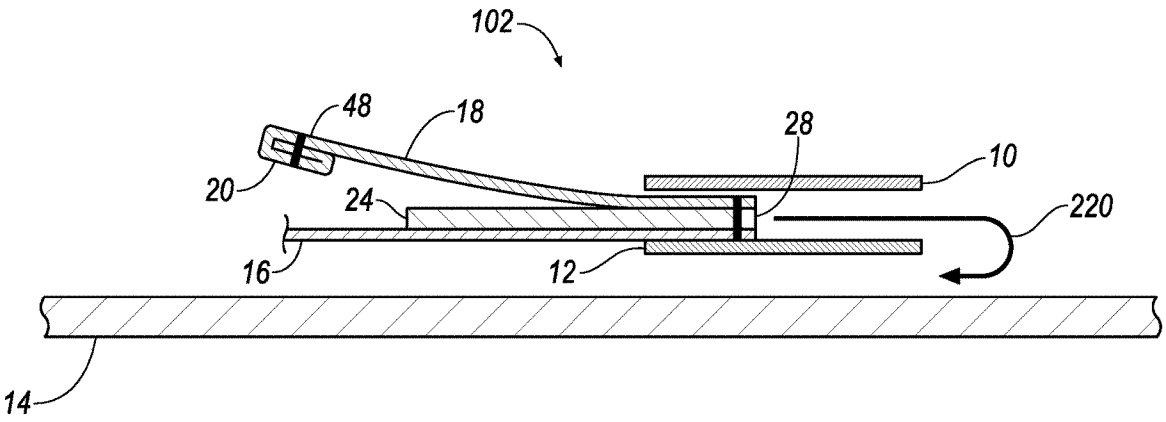
Figure 8:
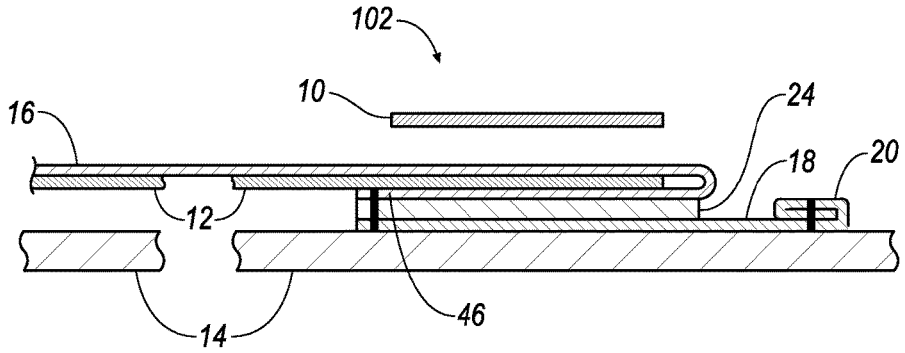
FIGS. 8-10 are side views of additional implementations of the releasable fastener system of FIG. 1 in the fastened state.
Figure 9:
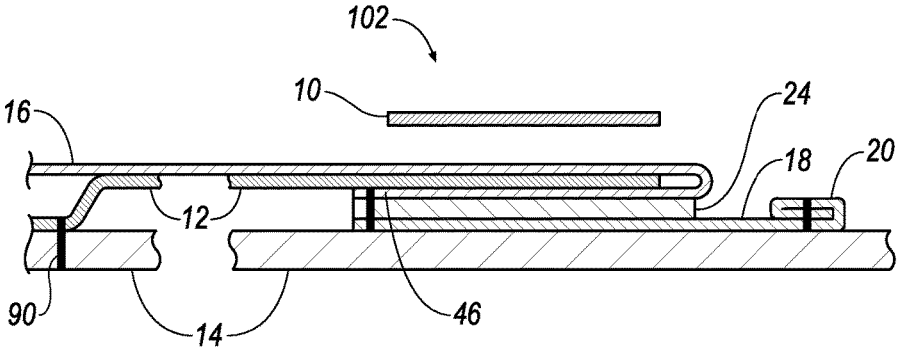

Referring to FIGS. 2A-2C, an isometric view (FIG. 2A) and side views (FIGS. 2B-2C) of the releasable fastener system 102 of FIG. 1 is illustrated when a fastening step initiates. In some implementations, the releasable fastener system 102 includes a top loop 10 and a bottom loop 12 associated with the first strap portion 14. In some examples, one of the top and bottom loops 10, 12, respectively, fasten to the first base material of the first strap portion 14. In other examples, both of the top and bottom loops 10, 12, respectively, fasten to the first base material (e.g., front portion 36) of the first strap portion 14. Additionally, one or more portions of the top and bottom loops 10, 12, respectively, may fasten together. In some examples, fastening of one or both of the top and bottom loops 10, 12, respectively, to the first strap portion 14 utilizes sewing; however, other joining techniques, such as rivets and adhesives, may be utilized. In some implementations, the top loop 10 is a woven material such as a fabric having a width of about one inch while the bottom loop 12 is wider than the top loop 10, as shown in FIGS. 8 and 9.

Figure 7:
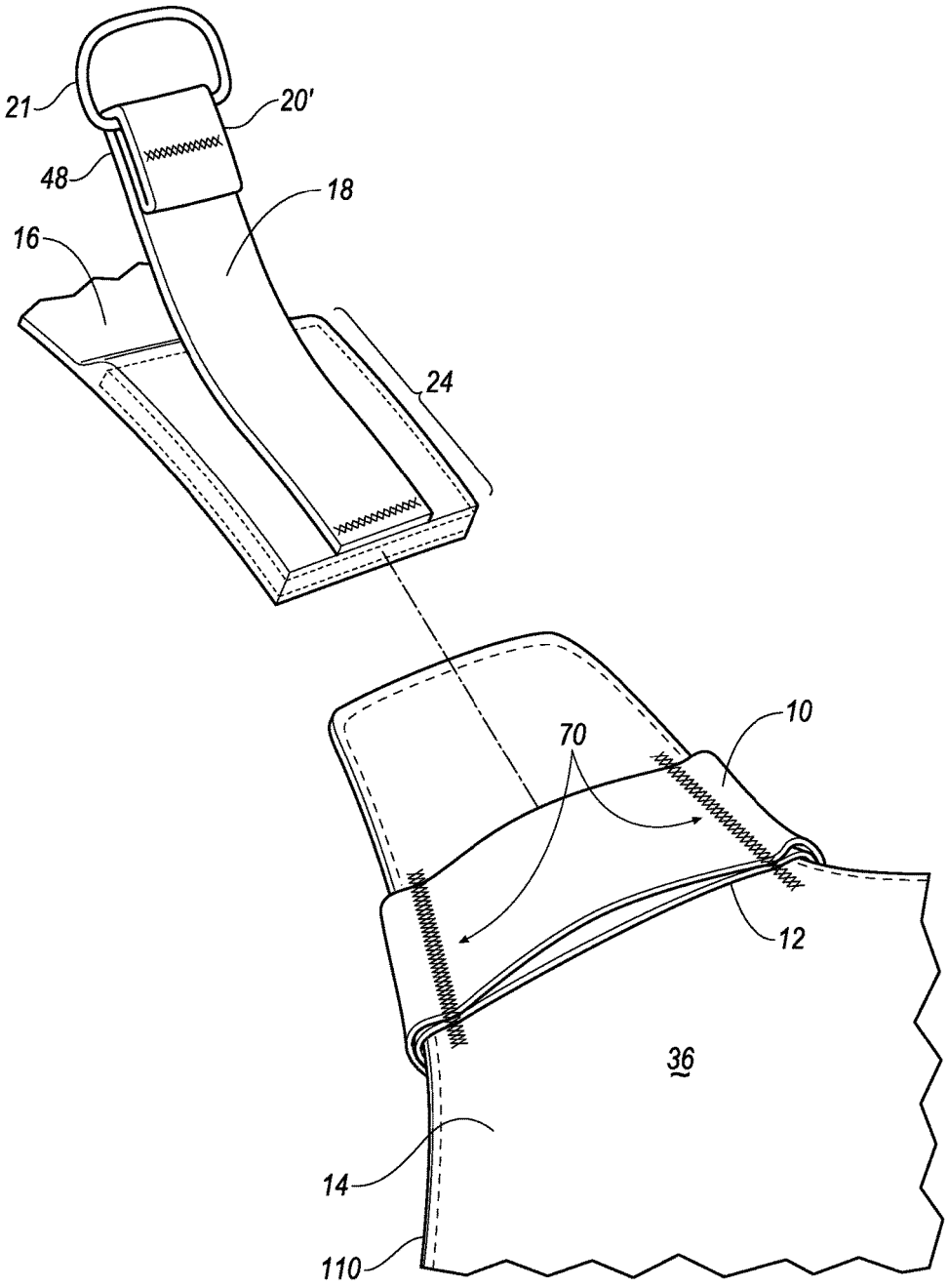
FIG. 7 is an isometric view of another implementation of the releasable fastener system of FIG. 1.

The releasable fastener system 102 may further include a pull 18 and a stiffening member 24 (e.g., stiffening tab) that fasten to the second strap portion 16. The pull 18 may be fabricated from the same type of material as that of the second base material 16 or the first base material 14. In some implementations, the pull 18 is fabricated from at least one of polyethylene or acetyl. In some implementations, the pull 18 is encased in at least one of nylon, Cordura, or polyester; however, the pull 18 may not be encased in any material at all. In some examples, the pull 18 includes a first end region 58 that fastens to the stiffening member 24. In the examples shown in FIGS. 2A-2C, the first end region 58 of the pull tab 18 fastens to a top surface 26 of the stiffening member 24 proximate to a leading edge 28 of the second strap portion 16. In other examples, the pull 18 is integral to the stiffening member 24. Additionally or alternatively, the first end region 58 of the pull 18 may fasten to layers of folded over woven material such as a fabric of the stiffening member 24 and/or portion of the second strap portion 16 (e.g., second base material) proximate to the leading edge 28. In some examples, fastening of the pull 18 to the stiffening member 24 and/or the second strap portion 16 utilizes sewing; however, other joining techniques, such as rivets and adhesives, may be utilized. In the examples shown, a second end region 48 of the pull 18 terminates into a beaded end region formed by folding the pull 18 upon itself to enable a slip free grip 20 for a user. In the example shown (FIG. 2A), and as depicted in FIGS. 2-6 and 8-10, the beaded end region at the second end region 48 of the pull 18 is formed by folding the pull 18 in a counter-clockwise direction upon itself such that the grip 20 protrudes toward the second strap portion 16 (FIG. 2A). In other examples, the grip 20' (FIG. 7) is rolled in a clock-wise direction causing grip 20' to protrude away from the second strap portion 16 (FIG. 7). In some implementations, as shown in FIG. 7, the second end region 48 of the pull 18 could include a plastic or metal D- or O-ring end for the user to grasp grip 20 instead of, or in addition to, the beaded end region.

In the examples shown, the stiffening member 24 resides between the second strap portion 16 and the pull 18. In some implementations, the stiffening member 24 is fabricated from a rigid material or a semi-rigid material such as, but not limited to, leather. The stiffening member 24 may fasten to the second strap portion 16, and in some examples, a bottom surface 36 of the stiffening member 24 attaches to a terminal portion 46 of the second strap portion 16, proximate to the leading edge 28, using hook and loop fasteners. The magnitude of hook engagement may vary depending upon a desired strength of the fastening between the stiffening member 24 and the second strap portion 16. In other examples, the stiffening member 24 attaches to the second strap portion 16 using sewing; however, other joining techniques, such as rivets and adhesives, may be utilized. The stiffening member 24 may be elongated, widened, shortened, or thinned depending upon the application of the of the releasable fastener system 102. For instance, a smaller vest 100 might utilize a smaller stiffening member 24 than a larger vest 100. In some implementations, as shown in FIG. 7, the second strap portion 16 is comprised of two or more plies. Stiffening member 24 may be located between two of the plies. In an implementation, the two or more plies encase and completely cover all of the sides of the stiffening member 24 such that all of the corners and edges of the stiffening member are impeded from catching on loops 10, 12 when the releasable fastener system is being fastened or being released. For purposes of this embodiment "encase" and "completely cover" are synonymous and mean that none of the corners or edges that make up stiffening member 24 are within view.

As shown in FIG. 2A, from the released state, the fastening step initiates by the user inserting or feeding the leading edge 28 (e.g., terminal portion 46) of the second strap portion 16 (e.g., second base material) in the direction of arrow 210 between the top and bottom loops 10, 12, respectively. Specifically, the leading edge 28 of the second strap portion 16, the pull 18, and the stiffening member 24 feed under the top loop 10, while over the bottom loop 12, in the direction of arrow 210. The combination of the second strap portion 16, pull tab 18, and stiffening member 24 can be referred to as a male portion 204. As shown in FIGS. 2B and 2C, an area between the top and bottom loops 10, 12, respectively, provides a first spacing for receiving the male portion 204. Upon exiting the first spacing between the loops 10 and 12, at least a portion of the male portion 204 is to be tucked under the bottom loop 12 as shown by the direction of arrow 220 in FIG. 2C (and FIG. 3A).

Referring to FIGS. 3A-3B, an isometric view (FIG. 3A) and a side view (FIG. 3B) of the releasable fastener system 102 are illustrated during the fastening step after the male portion 204 exits the first spacing between the top and bottom loops 10, 12, respectively. In some implementations, the stiffening member 24 is semi-rigid allowing the stiffening member 24 to roll about itself for tucking under the bottom loop 12 upon exiting the spacing between the loops 10 and 12, as shown in FIG. 3A. In other implementations, however, the stiffening member 24 is rigid and cannot roll about itself, but rather, the second strap portion 16 is folded to flip the orientation of the stiffening member 24 such that the top surface 26 of the stiffening member 24 (and the pull 18) is reversed. In the examples shown, the bottom loop 12 and first strap portion 14 (e.g., first base material) define a cavity or second spacing for receiving the male portion 24 translating in the direction of arrow 310 under the bottom loop 12. In some examples, the user may tuck the male portion 204 by pulling the leading edge 28 of the second strap portion 16 in the direction of arrow 310 such that at least a portion of the stiffening member 24 and the first end region 58 of the pull 18 resides within the second spacing (e.g., cavity) between the bottom loop 12 and the first strap portion 14. In other examples, the user may tuck the male portion 204 by pushing or jamming the male portion 204 in the direction of arrow 310 into the cavity such that at least a portion of the stiffening member 24 and the first end region 58 of the pull 18 resides within the second spacing between the bottom loop 12 and the first strap portion 14. In some implementations, the user ensures that the second end region 48 of the pull 18 does not reside within the second spacing between the bottom loop 12 and the first strap portion 14.

Referring to FIGS. 4A-4B, an isometric view (FIG. 4A) and a side view (FIG. 4B) of the releasable fastener system 102 are illustrated in the fastened state. In the fastened state, at least a portion (e.g., terminal portion 46) of the second strap portion 16 (e.g., second base material), the first end region 58 of the pull 18, and the stiffening member 24 reside in the second spacing (e.g., cavity) between the bottom loop 12 and the first strap portion 14 upon being tucked under the bottom loop 12 and received therein. Further, the second end region 48 of the pull 18 is not tucked or rolled under the bottom loop 12, and simply overlays the first strap portion 14 of the front portion 36. In the examples shown, the second strap portion 16 secures or fastens to the first strap portion 14 for achieving the fastened state of the releasable fastener system 102 whereat the tucking by the stiffening member 24, the first end region 58 of the pull 18, and the second strap portion 16 into the second spacing between the bottom loop 12 and the first strap portion 14 creates a leverage type attachment. This leverage type attachment effectively couples, fastens, or otherwise attaches, the second strap portion 16 to the first strap portion 14. For instance, the stiffening member 24, being rigid or stiff, resists releasing from residing within the cavity when tension is on the shoulder strap. In other words, the first strap portion 14 associated with the front portion 36 may pull in one direction due to gravity while the second strap portion 16 associated with the back portion 38 pulls in an opposite direction about the cavity to create tension necessary for the leverage type attachment when the vest 110 is worn by the user. Described in further detail below with reference to FIGS. 5A-5F, the stiffening member 24 easily releases or disengages from the second spacing between the bottom loop 12 and the first strap portion 14 when the grip 20 of the pull 18 is pulled. While the examples illustrate the releasable fastener system 102 utilized to fasten first and second strap portions 14, 16, respectively, to form the shoulder strap of the vest 110, the releasable fastener system 102 may be adapted to attach/fasten and release other products such as, but not limited to, back packs or pouches independently or in conjunction with the vest 110.

Figure 5C:
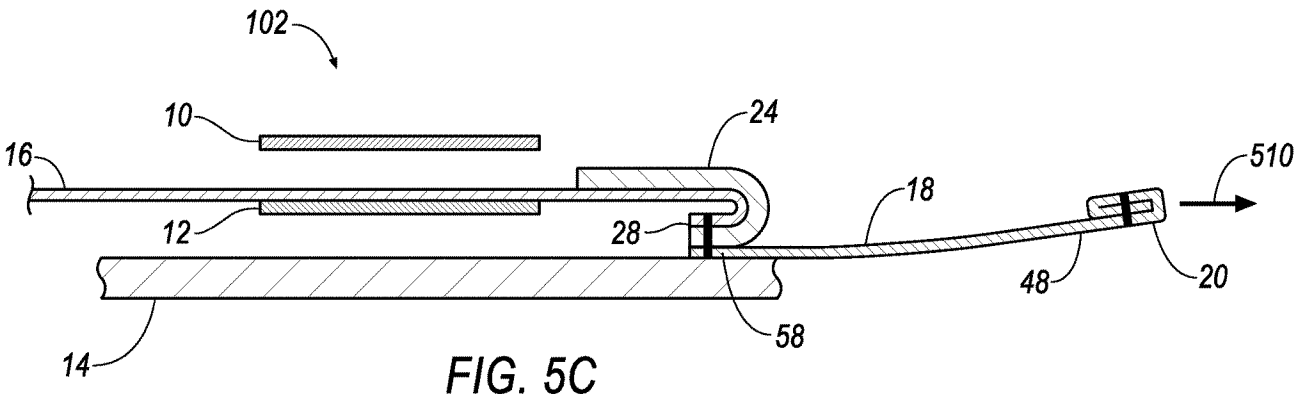
Figure 5D:
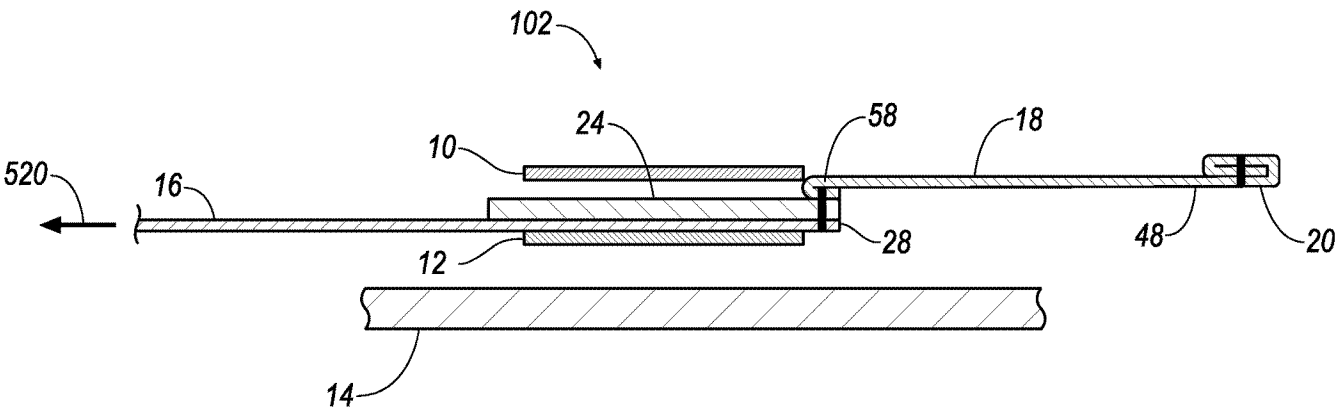

FIGS. 5A-5F are isometric (FIG. 5A) and side (FIGS. 5B-5F) views through a plurality of steps for releasing the releasable fastener system 102 from the fastened state. Referring to FIGS. 5A and 5B, to initiate releasing the releasable fastener system 102, the user may pull the pull tab 18, via the grip 20, in the direction of arrow 510 away from the loops 10 and 12 causing the stiffening member 24, the first end region 58 of the pull 18, and the second strap portion 16 to release the leverage type attachment with the first strap portion 14 at the second spacing. In some examples, as shown in FIGS. 5C and 5D, the second end region 48 of the pull 18 continues to be pulled, via the grip 20, in the direction of the arrow 510 upon the stiffening member 24, the first end region 58 of the pull 18, and the leading edge 28 of second strap portion 16 releasing from the cavity (FIG. 5C) until the stiffening member 24 and the second strap portion 16 are un-rolled (FIG. 5D). As shown in FIG. 5D, the second strap portion 16 may be pulled from the side of the loops 10 and 12 opposite the second end region 48 of the pull 18 in an opposite direction indicated by arrow 520 (FIG. 5D).

Figure 5E:
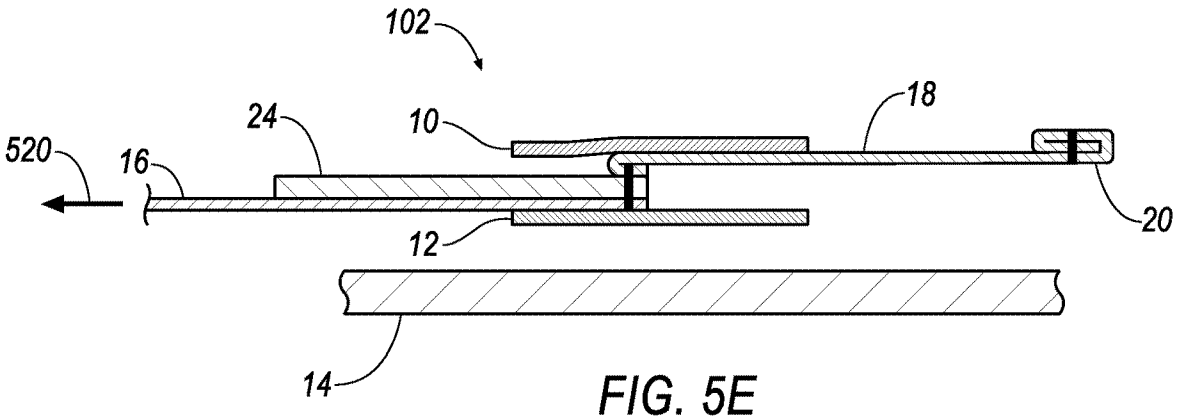
Figure 5F:
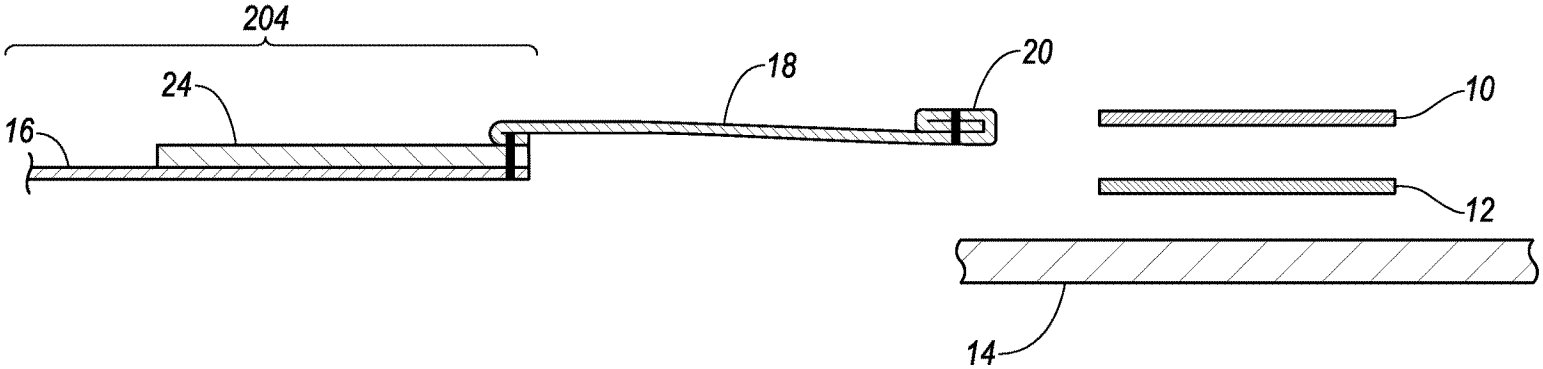

Referring to FIG. 5E, pulling the second strap portion 16 in the opposite direction, indicated by arrow 520, allows the stiffening member 24, the pull 18, and the second strap portion 16 to be pulled out of—or otherwise released from—the first spacing between the top and bottom loops 10, 12, respectively. Referring to FIG. 5F, the male portion 204 is entirely released from the top and bottom loops 10, 12, respectively, to achieve the released state of the releasable fastener system 102.

FIG. 6 is an isometric view of the vest 110 in the released state subsequent to releasing the releasable fastener system 102. Here, the user may remove the second strap portion 16 away from the front portion 36 to facilitate removal of the vest 110 from the user. In some implementations, the user releasing the releasable fastener system 102 is different than the user wearing the vest.

FIG. 7 is an isometric view of another implementation of the releasable fastener system 102 of FIG. 1. In some implementations, the second strap portion 16 splits/plies into halves to embed and completely cover the stiffening member 24 to effectively hide the stiffening member 24 from being exposed on the exterior of the vest 100 such that the stiffening member 24 does not catch on surfaces thereof and inhibit fastening and/or releasing the releasable fastener system 102.

In some implementations, the grip 20' formed at the second end region 48 of the pull 18 protrudes in an opposite direction compared to the examples shown in FIGS. 2-6 and 8-10. For instance, in the example shown, the grip 20' is formed by folding the pull 18 in a clockwise direction upon itself such that the grip 20' protrudes away from the second strap portion 16. Thus, when the releasable fastener system 102 is in the fastened state as shown in FIG. 4B, the grip 20' would instead protrude into contact with the first strap portion 14 to prevent edges of the grip 20' to not catch on other surfaces or objects that may result in unintentional releasing of the releasable fastener system 102. In some examples, the pull 18 could include a plastic or metal D- or O-ring 21 for the user to grip 20' instead of, or in addition to, the beaded end region. In the example shown, the second end region 48 of the pull 18 is inserted through the D-ring 21 and folded in the clockwise direction upon itself to secure the D-ring 21 to the pull 18.

In some examples, two rows of stitching (such as bar tacks) 70 are spaced from one another at a desired distance to restrict lateral movement of the second strap portion 16, the first end region 58 of the pull 18, and the stiffening member 24 residing in the second spacing (e.g., cavity) between the bottom loop 12 and the first strap portion 14 when the system 102 is in the fastened state (shown in FIG. 4B). Excessive lateral movement is undesirable because it can cause an unintentional release of the stiffening member 24 from the cavity. The bar tacks 70 may penetrate through the top and bottom loops 10, 12, respectively, and into the first strap portion 14 to tack the materials 10 and 12 down to the first strap portion 14. In the example shown, the bar tacks 70 include a programmable stitching pattern, wherein each row 70 is substantially about an eighth of an inch wide. In other examples, the materials 10 and 12 may be tacked down to the first strap portion 14 using at least one of sewing, rivets, or adhesives.

Referring to FIGS. 8 and 9, in some implementations, the top loop 10 is comprises of a material of one inch width while the bottom loop 12 is wider than the top loop 10. The bottom loop 12 may be formed from the same material as the first strap portion 14. As shown in a side view of the releasable fastener system 102 of FIG. 8, the width of the bottom loop 12 extends beyond the top loop 10 while the stiffening member 24 resides between the bottom loop 12 and the first strap portion 14 when in the fastened state. The bottom loop 12 and the first strap portion 14 may be joined along one or more of their surfaces or edges.

In some implementations, as shown in a side view of the releasable fastener system 102 of FIG. 9, the bottom loop 12 secures, via a fastener 90, to the first strap portion 14 at a location beyond the stiffening member 24 to form one wall of a pocket for receiving the stiffening member 24. For instance, the pocket is associated with the cavity defined by the bottom loop 12 and the first strap portion 14. Moreover, the width of the bottom loop 12 extends beyond the top loop 12. The fastener 90 for securing the bottom loop 12 to the first strap portion 14 may include at least one of hook and loop fasteners, sewing, rivets, or adhesives. Moreover, the side edges of the bottom loop 12 and the first strap portion 14 may be sewn such that a single opening exists for the stiffening member 24 to be received within the pocket/cavity. Accordingly, when the stiffening member 24 is received in the cavity/pocket between the bottom loop 12 and the first strap portion 14, the stiffening member 24 may be completely enclosed and not exposed.

Figure 10:
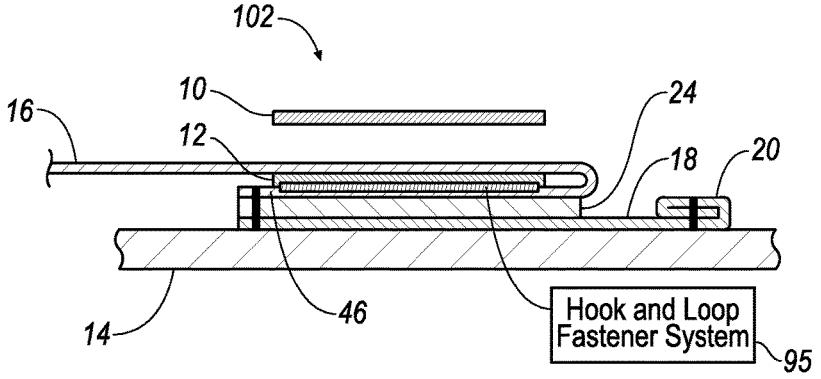

FIG. 10 shows another implementation of a side view of the releasable fastener system 102 in the fastened state. In the example shown, a hook and loop fastener system 95 secures the bottom surface of the bottom loop 12 to the top surface of the stiffening member 24 to provide additional fastening between the stiffening member 24 and the bottom loop 12 in the fastened state. In one example, hooks may be disposed on the bottom surface of the bottom loop 12 and loops may be disposed on the bottom surface of the stiffening member 24. In another example, loops may be disposed on the bottom surface of the bottom loop 12 and hooks may be disposed on the bottom surface of the stiffening member 24. In implementations when the second strap portion 16 is plied/split into halves to embed and completely cover the stiffening member 24, as shown in FIG. 7, the hooks or loops may be disposed on the second strap portion 16 in the region covering the stiffening member 24.

Figure 11:
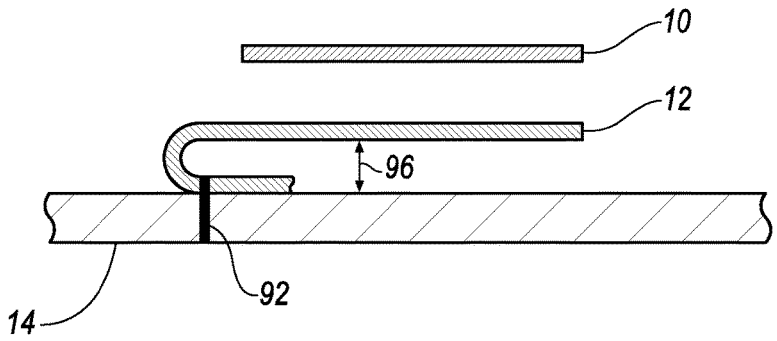
FIGS. 11 and 12 are side views of additional implementations of the releasable fastener system of FIG. 1 defining a pocket.

Referring to FIG. 11, in some implementations, the bottom loop 12 is rolled over and attached to the first strap portion 14 to form a pocket 96 associated with the cavity defined by the bottom loop 12 and the first strap portion 14. In the example shown, the stiffening member 24 may be at least partially, or, alternatively completely received within the pocket 96 when the releasable fastener system 102 is in the fastened state. In some examples, the bottom loop 12 is attached to the first strap portion 14 via a fastener 92, such as, but not limited to, fasteners, sewing, rivets, or adhesives. In other examples, the bottom loop 12 is formed from one or more plies of material partially separated from the plies of material which may comprise the first strap portion 14. For instance, the bottom loop 12 may be a portion of one or more layers (or plies) of material partially separated from the first strap portion 14. Edges of the bottom loop 12 and the first strap portion 14 may be joined such that the stiffening member 24 when residing in the pocket 96 is at least partially covered, or, alternatively, entirely covered and not exposed.

Figure 12:
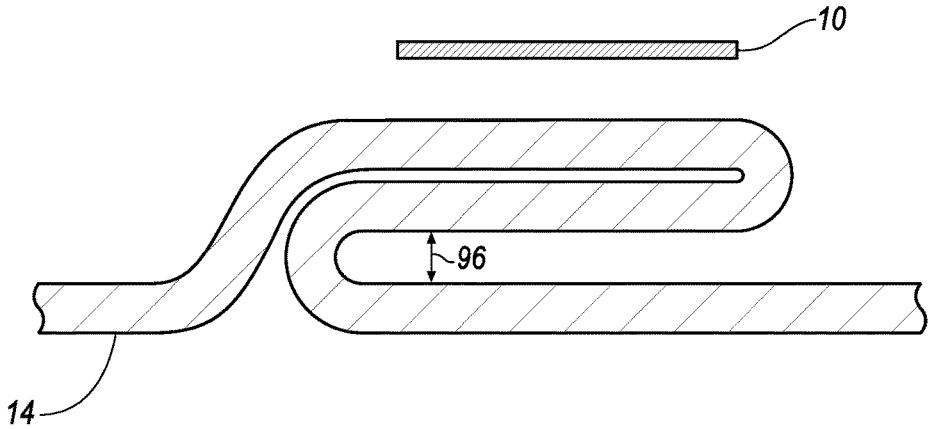

In another implementation, FIG. 12 shows the first strap portion 14 being rolled about itself to define the loop 12 and the pocket 96 described above with reference to FIG. 11. Here, the bottom loop 12 is defined by at least a portion of the first strap portion 14 to create the pocket 96 associated with the cavity for receiving the stiffening member 24 when the releasable fastener system 102 is in the fastened state. In the region defining the cavity 96, edges of the first strap portion 14 may be joined such that the stiffening member 24 when residing in the pocket 96 is entirely covered and not exposed.

A number of implementations have been described. Nevertheless, it will be understood that various modifications may be made without departing from the spirit and scope of the disclosure. Accordingly, other implementations are within the scope of the following claims.

What is claimed is:

1. A releasable fastener system comprising:

a first base material and a second base material being fastened together when the fastener system is in a fastened state and released from one another when the fastener system is in a released state;

a stiffening member fastened to the second base material;

a bottom loop spaced from the first base material such that at least a portion of the stiffening member resides between the bottom loop and the first base material when the fastener system is in the fastened state; and a top loop being spaced from the bottom loop such that a portion of the second base material resides between the top and bottom loops when the system is in the fastened state, wherein at least one of the top and bottom loops is fastened to the first base material, and wherein at least a portion of the top loop overlaps at least a portion of the bottom loop.

2. The releasable fastener system of claim 1, wherein edges of bottom loop and the first base material are joined to define a pocket such that stiffening member is not exposed when residing between the bottom loop and the first base material when the fastener system is in the fastened state.

3. The releasable fastener system of claim 1, further comprising:

a pull having a first end region and a second end region, the first end region being one of integral or fastened to the stiffening member such that the stiffening member resides between the first end region of the pull and the second base material.

4. The releasable fastener system of claim 3, wherein pull releases the releasable fastener system from the fastened state when the second end region of the pull is pulled to release the stiffening member from residing between the bottom loop and the first base material.

5. The releasable fastener system of claim 3, wherein the second end region of the pull terminates into a beaded end region formed by folding the second end portion upon itself to enable a grip for a user.

6. The releasable fastener system of claim 5, wherein the beaded end region is in contact with the first base material when the releasable fastener system is in the fastened state.

7. The releasable fastener system of claim 5, wherein the beaded end region protrudes from the pull in a direction away from the first base material when the releasable fastener system is in the fastened state.

8. The releasable fastener system of claim 5, wherein a ring is secured to the beaded end region to enable the grip for the user.

9. The releasable fastener system of claim 1, wherein the residing of the stiffening member between the bottom loop and the first base material creates a leverage type attachment to fasten the second base material and the first base material together.

10. The releasable fastener system of claim 1, wherein the stiffening member fastens to the second base material using hook and loop fasteners.

11. The releasable fastener system of claim 1, wherein the stiffening member is entirely embedded within the second base material.

12. The releasable fastener system of claim 1, wherein the stiffening member fastens to the bottom loop using a hook and loop fastener system when the releasable fastener system is in the fastened state.

13. The releasable fastener system of claim 1, wherein one of the top and bottom loops is fastened to the other one of the top and bottom loops.

14. The releasable fastener system of claim 1, wherein both of the top and bottom loops are fastened to the first base material.

15. The releasable fastener system of claim 1, wherein the first and second base materials are fastened to a vest.

16. The releasable fastener system of claim 1, wherein at least one of the first or second base materials is at least indirectly fastened to at least one of a back-pack, a carrying pouch, or a belt.

17. A releasable fastener system for a protective vest, the releasable fastener system comprising:

a first strap portion and a second strap portion forming a shoulder strap when the second strap portion fastens to the first strap portion;

a top loop and a bottom loop wherein at least one of the top or bottom loops is fastened to the first strap portion, the bottom loop residing between the top loop and the first strap portion wherein at least a portion of the top loop overlaps at least a portion of the bottom loop;

a pull having a first end region fastened to the second strap portion;

the top loop and the bottom loop being spaced such that a portion of the second strap portion resides between the top and bottom loops when the second strap portion fastens to the first strap portion; and the bottom loop and the first strap portion being spaced such that the second strap portion resides between the bottom loop and the first strap portion to provide a leverage type attachment for fastening the second strap portion to the first strap portion.

18. The releasable fastener system of claim 17, further comprising:

a stiffening member residing between the first end region of the pull and a terminal portion of the second strap portion.

19. The releasable fastener system of claim 18, wherein the stiffening member attaches to the terminal portion of the second strap portion using at least one of hook and loop fasteners, sewing, rivets, or adhesives.

20. The releasable fastener system of claim 18, wherein the stiffening member attaches to the first end region of the pull using at least one of sewing, rivets, or adhesives.

21. The releasable fastener system of claim 18, wherein the stiffening member is fabricated from at least one of a rigid or a semi-rigid material.

22. The releasable fastener system of claim 17, wherein the pull having the first end region fastened to the second strap portion comprises the first end region of the pull attaching to a terminal portion of the second strap portion using at least one of sewing, rivets, or adhesives to fasten the pull to the second end portion.

23. The releasable fastener system of claim 17, wherein the pull is encased in at least one of nylon, Cordura, or polyester.

* * * * *